United States Patent [19]

Fuchs, Jr.

[11] 4,068,517

[45] Jan. 17, 1978

[54] METHODS AND APPARATUS FOR FORMING WIRE TAPES

[75] Inventor: Francis Joseph Fuchs, Jr., Princeton Junction, N.J.

[73] Assignee: Western Electric Company, Inc., New York, N.Y.

[21] Appl. No.: 670,467

[22] Filed: Mar. 25, 1976

[51] Int. Cl.[2] ..... B21C 23/02; B21C 25/02

[52] U.S. Cl. ..... 72/253 R; 72/254; 72/256; 72/260; 72/261; 72/468; 425/461

[58] Field of Search ..... 72/253, 256, 261, 203, 72/204, 467, 468, 254; 425/130, 131.1, 461; 207/10.3; 264/DIG. 47, 277 F, 277 R

[56] References Cited

U.S. PATENT DOCUMENTS

| | | | |
|---|---|---|---|
| 885,508 | 4/1908 | McKee | 72/203 |
| 1,136,373 | 4/1915 | Shedlock | 72/204 |
| 1,977,285 | 10/1934 | Cleery | 72/204 |
| 2,074,713 | 3/1937 | Tross | 29/415 |
| 2,489,951 | 11/1949 | Bump | 264/177 F UX |
| 3,164,947 | 1/1965 | Gaston | 264/177 R X |
| 3,321,950 | 5/1967 | Gettig | 72/255 |
| 3,470,685 | 10/1969 | Hall et al. | 264/177 F UX |
| 3,901,065 | 8/1975 | Schmehl | 72/261 |

FOREIGN PATENT DOCUMENTS

| | | | |
|---|---|---|---|
| 1,458,218 | 10/1965 | France | 72/261 |
| 612,622 | 5/1935 | Germany | 72/467 |
| 1,458,013 | 12/1968 | Germany | 72/256 |
| 449,247 | 4/1968 | Sweden | 264/177 F |
| 1,061,680 | 3/1967 | United Kingdom | 72/261 |

*Primary Examiner*—C.W. Lanham
*Assistant Examiner*—D. M. Gurley
*Attorney, Agent, or Firm*—A. S. Rosen

[57] ABSTRACT

A tape, which includes a number of parallel-extending, elongated wires of substantially circular cross-section, is formed by subjecting an elongated workpiece to two stages of deformation. In a first stage, the workpiece acquires an intermediate structure, in the form of a tape composed of a number of parallel-extending elongated elements, each having a cross-section which preferably includes a pair of diametrically opposed, substantially circular, arcuate portions. The cross-section of each elongated element also includes a non-circular, junction region converging toward the adjacent lateral edge of each adjacent elongated element. Each pair of adjacent elongated elements in the intermediate structure is joined together along the adjacent lateral edges, by two such junction regions, one included in each of the elongated elements of the pair. The contacting junction regions preferably meet one another along flat surfaces at approximately ninety degree angles. In the second stage of deformation, the intermediate structure is subjected to transverse, and preferably substantially lateral, compression forces which serve to deform each junction region into a generally circular, arcuate, cross-sectional shape. The two stages of deformation may take place one immediately following the other by the extrusion of the elongated workpiece through a suitably configured die having two longitudinally aligned deformation zones.

11 Claims, 9 Drawing Figures

FIG. 1
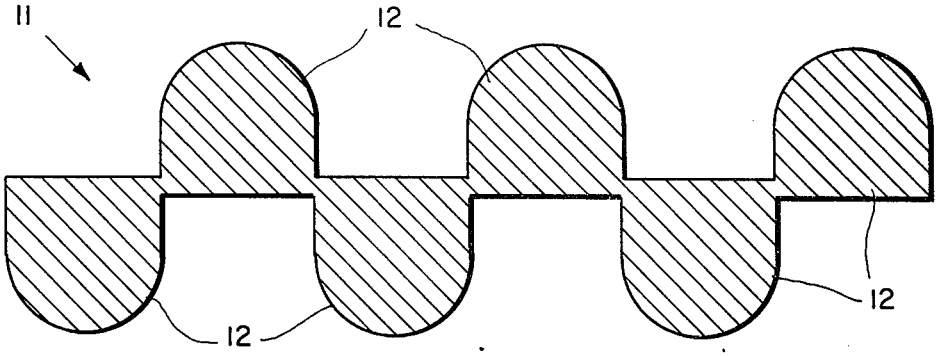
FIG. 2
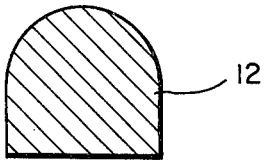
FIG. 3
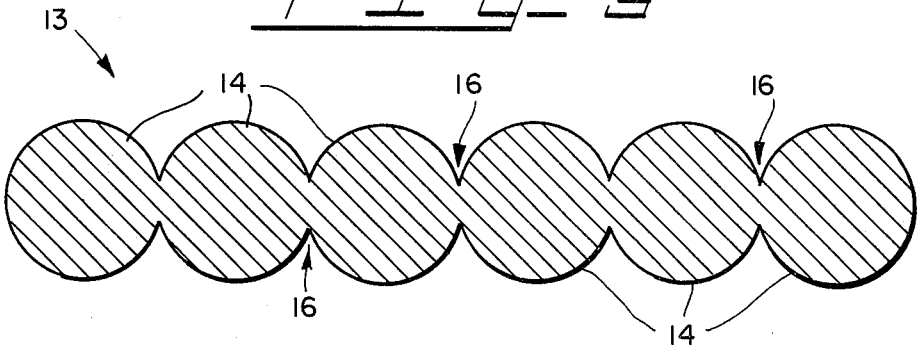
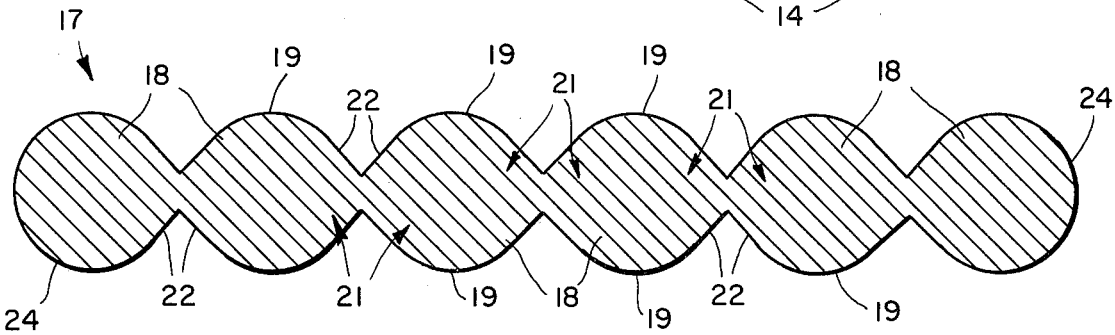
FIG. 4

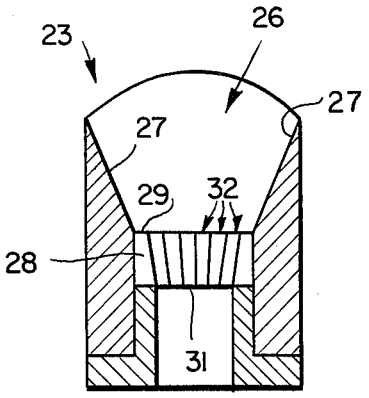
FIG. 5
FIG. 6
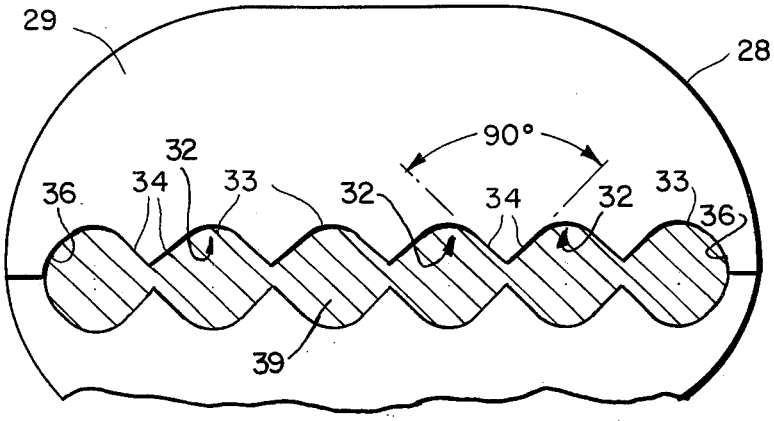
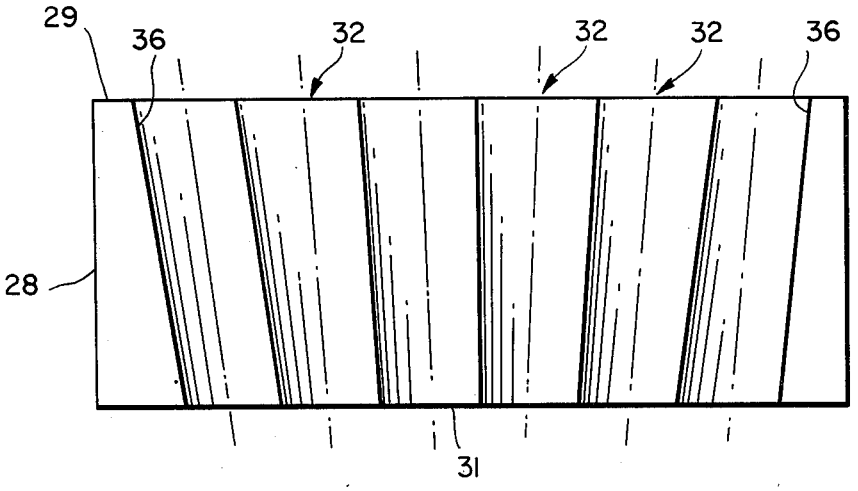
FIG. 7

FIG. 8
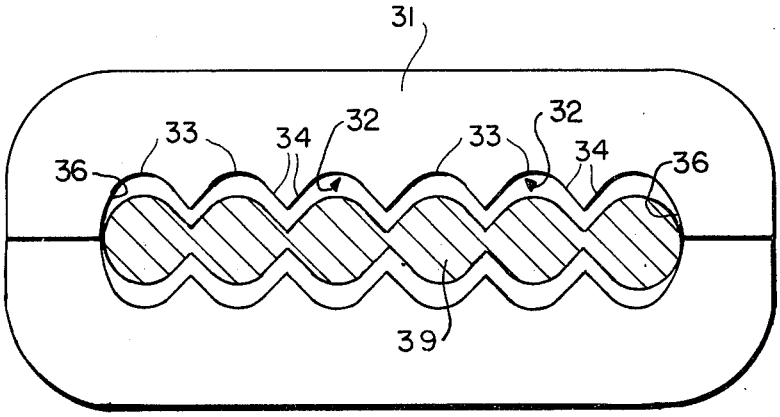
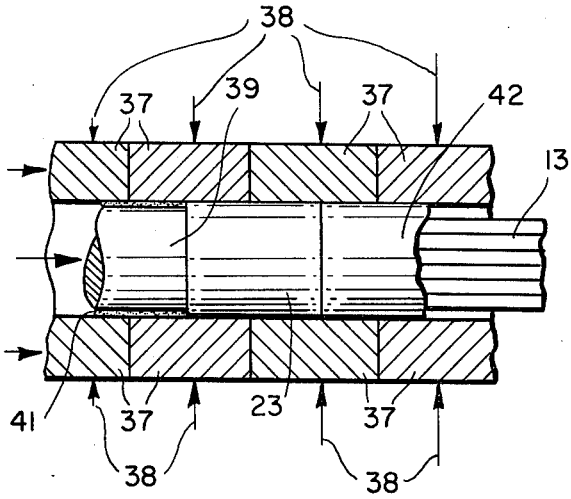
FIG. 9

METHODS AND APPARATUS FOR FORMING WIRE TAPES

BACKGROUND OF THE INVENTION

1. Field of the Invention

This invention relates to methods and apparatus for forming elongated products and, more particularly, to methods and apparatus for deforming an elongated workpiece so as to form an integral article, which integral article includes a number of parallel-extending elongated members.

2. Description of the Prior Art

In the art of forming elongated products, it is known to utilize hydrostatic extrusion techniques, wherein hydrostatic pressure is applied to a billet within a chamber such that the material of the billet is rendered more ductile as the billet is forced through an aperture in a die located at one end of the chamber. Some examples of such techniques may be found in my U.S. Pat. No.3,740,985, application for the reissue of which has been made on Jan. 4, 1974 under Ser. No. 430,984, and in my copending application, Ser. No. 612,875, filed September 12, 1975 and entitled, "Continuous Wire Extrusion".

In my copending application Ser. No. 638,494, filed Dec. 8, 1975 (now abandoned) and entitled, "Methods and Apparatus for Forming and Handling Elongated Products," there are disclosed techniques for forming and handling elongated, integral structures, such as tapes, wherein the tapes take the form of a number of elongated products, such as wires, extending longitudinally in parallel and joined together along their lateral edges by additional elements of interconnecting material. Such techniques involve the deforming of a workpiece, e.g., by hydrostatic extrusion of the workpiece through a die with a suitably configured aperture, in order to form the tapes, which tapes may include parallel-extending elongated products of various shapes. Two specifically suggested shapes for the cross-sections of the elongated products are generally semicircular and generally square. Examples of such a tape which includes a number of generally semicircular, parallel-extending, elongated products, and of one of the products, are illustrated in FIGS. 1 and 2 of the drawing.

It is considered desirable to be able to product tapes which include fully circular, parallel-extending, elongated products, as shown in FIG. 3 of the drawing. It should be clear, however, that, in order to form such tapes by the technique disclosed in my copending application Ser. No. 638,494, as discussed, the appropriate die configuration would have to include a number of relatively very sharp and very thin projecting edges in order to define the spaces between adjacent circular portions of substantially tangent elongated products. It is, of course, not considered feasible to utilize a die with projecting edges of such a nature, in view of the likelihood of edge breakage and/or extremely rapid edge wear due to the high pressure associated with tape formation. Accordingly, it should be evident that there is a need for the provision of other methods and apparatus for forming tapes composed of parallel-extending, elongated products, each having a substantially fully circular cross-section.

SUMMARY OF THE INVENTION

The invention contemplates the forming of an integral article, such as a tape, which tape includes a number of parallel-extending, elongated members, each of substantially circular cross-section, by subjecting an elongated workpiece to two stages of deformation. In a first stage, the workpiece acquires an intermediate structure, in the form of a tape composed of a number of parallel-extending elongated elements, each having a cross-section which preferably includes a pair of diametrically opposed, substantially circular, arcuate portions. The cross-section of each elongated element also includes a non-circular, junction region converging toward the adjacent lateral edge of each adjacent elongated element. Each pair of adjacent elongated elements in the intermediate structure is joined together along the adjacent lateral edges by two such junction regions, one included in each of the elongated elements of the pair. The contacting junction regions preferably meet one another along flat surfaces at approximately ninety degree angles. In the second stage of deformation, the intermediate structure is subjected to transverse, and preferably substantially lateral, compression forces which serve to deform each junction region into a generally circular, arcuate, cross-sectional shape. The two stages of deformation may take place one immediately following the other by the extrusion of the elongated workpiece through a suitably configured die having two longitudinally aligned deformation zones.

BRIEF DESCRIPTION OF THE DRAWING

FIG. 1 of the drawing is a lateral cross-sectional view of a type of plural wire tape which may be formed by the techniques of my copending application, Ser. No. 638,494, filed Dec. 8, 1975 (now abandoned) and entitled, "Methods and Apparatus for Forming and Handling Elongated Products," which tape includes a number of parallel-extendng wires of generally semicircular cross-section;

FIG. 2 is a lateral cross-sectional view of one of the wires of the tape of FIG. 1, subsequent to separation of the wire from the tape;

FIG. 3 is a lateral cross-sectional view of a desired product, constituting a tape which includes a number of wires of circular cross-section, extending longitudinally in parallel and arrayed along a laterally extending line with the wires contacting one another substantially along longitudinal lines of tangency between adjacent wires;

FIG. 4 is a lateral cross-sectional view of an intermediate structure which may be formed in the course of producing the tape of FIG. 3 in accordance with the principles of the present invention;

FIG. 5 is a horizontal cross-sectional view of a die asssembly which may be utilized to produce the tape of FIG. 3;

FIGS. 6 through 8 are views of various protions of a die included in the die assembly of FIG. 5, indicating the configuration of the die aperture; and FIG. 9 is a longitudinal view, partly in section, of portions of apparatus which may utilize a die such as that of FIGS. 6–8 in order to produce the tape of FIG. 3.

DETAILED DESCRIPTION

Referring initially to FIGS. 1 and 2 of the drawing, a tape 11 includes a number of elongated members 12, such as wires, which extend longitudinally in parallel, perpendicularly to the plane of the drawing, and which are joined together along their lateral edges, in a laterally extending line, so as to form an integral structure.

Such a tape may be formed by the technique of my copending application, Ser. No. 638,494, filed Dec. 8, 1975 and entitled "Methods and Apparatus for Forming and Handling Elongated Products," which copending application points out the advantages of handling wires in tape form, as opposed to the handling of the wires individually.

Each of the wires 12 has a cross-sectional shape generally corresponding to a semicircle with a somewhat extended, rectangular base. This generally semicircular cross-sectional configuration is chosen primarily for purposes of convenience in manufacture pursuant to the techniques of my aforementioned copending application, Ser. No. 638,494. Since fully round wires are frequently preferred wires having over the depicted generally semicircular shape, each separated wire 12, such as that shown in FIG. 2, may have to undergo an additional rounding step, e.g., the drawing or extrusion of each such wire 12 through a die having a circular aperture.

Ideally, in order to avoid such additional drawing or extrusion operation, the tape would be formed with a shape such as that of tape 13, shown in FIG. 3 of the drawing. Each of the wires 14 of tape 13 has a fully circular cross-section, the wires 14 extending longitudinally in parallel while arrayed in a laterally extending line, and joined together in edge-to-edge contact substantially along parallel, longitudinally extending lines of tangency between adjacent wires 14.

It is evident that the spaces 16 between adjacent circular portions of adjacent wires 14 narrow down at increasingly small included angles as the lines of substantial tangency between the adjacent wires are approached. The forming of a tape such as that of FIG. 3 by the direct extrusion of a workpiece through a die having an aperture configured in conformity to the desired shape of the tape would, of course, not be practicable, in view of the likelihood that the required very sharp and very thin die edges, corresponding to the narrowing spaces 16, would quickly break or wear out at the necessarily high pressures involved in extrusion.

Turning next to FIG. 4 of the drawing, there is shown a tape 17, having a shape which can be extruded much more readily than can the shape of tape 13. The tape 17, which constitutes a preferred intermediate structure in forming the desired tape 13 of FIG. 3, includes a number of elongated elements 18 which extend longitudinally in parallel. Each elongated element 18 has a cross-section which includes a pair of diametrically opposed, substantially circular, arcuate portions 19. Adjoining, non-circular, junction regions 21 join together each adjacent pair of elongated elements 18, with the junction regions 21 being formed by surfaces 22 which converge toward adjacent lateral edges of adjacent elongated elements. The surfaces 22 preferably are flat, and preferably meet one another at angles of approximately ninety degrees along opposite faces of the tape 17 at each pair of adjacent junction regions 21. The preferred angle of about ninety degrees is selected to avoid the previously mentioned die edge problems in connection with a suitable extrusion die assembly, such as the die assembly 23 shown in FIG. 5 of the drawing, which die assembly will be discussed more fully hereinafter.

As has previously been mentioned, the tape 17 is intended as an intermediate structure for use in producing a tape which includes a number of substantially fully circular wires, such as the tape 13 of FIG. 3. The formation of the tape 17, thus, constitutes a first stage in the process for forming the desired tape 13. A second stage of such process will involve the application of transverse, and preferably lateral, compression forces to the outermost lateral edges 24 of the tape 17, the lateral compression forces tending to deform each junction region 21 into a generally circular, arcuate cross-sectional shape.

A die assembly 23, suitable for performing the two stages in the aforementioned process of forming the tape 13 of FIG. 3 in immediate succession, is shown in FIG. 5 of the drawing. The die assembly 23 includes an entrance zone 26, defined by entrance walls 27 which converge toward a die 28. The die 28 includes an overall die aperture of complex shape, which die aperture extends through the body of the die 28 from an entrance end 29 to an exit end 31 thereof. The die aperture includes two effective deformation zones, arrayed in longitudinal alignment. A first of the deformation zones constitutes that portion of the die aperture which is located at and immediately adjacent to the entrance end 29. The second deformation zone encompasses the remainder of the die aperture, i.e., the exit 31 and that portion of the die aperture located between the entrance end 29 and the exit end 31. The first and second stages of the process for forming the tapes 13, as described above, will take place as a workpiece is displaced longitudinally through the first and second deformation zones of the aperture of the die 28.

The first effective deformation zone of the die aperture, i.e., that portion of the die aperture at the entrance end 29, is shown in FIG. 6 of the drawing, wherein a corresponding cross-section of a workpiece 39 within the die aperture is also illustrated. The profile of the die aperture at this first deformation zone, as may be seen by a comparison of FIG. 6 with FIG. 4, is so configured as to match the profile of the intermediate structure which is to be produced by the first stage of the process, i.e., the tape 3. Thus, several individual, generally circular apertues 32, each having a circular shape along a central portion 33 of its periphery, are arrayed in a laterally extending line, and are interconnected by non-circular junction areas which converge along adjoining surfaces 34. The surfaces 34 which define the junction areas of the die aperture along the entrance end 29 are preferably substantially flat, and preferably meet one another at substantially ninety degree angles, while not quite extending to the plane of the centerlines of the individual, generally circular apertures 32. As a result of the use of such ninety degree angles, the junction areas of the die aperture are relatively resistant to wear and breakage during usage.

The second effective deformation zone of the die aperture, i.e., the portion of the die aperture other than that at the entrance end 29, may best be seen by reference now also to FIGS. 7 and 8 of the drawing, FIG. 8 illustrating the exit end 31 of the die 28, including a corresponding cross-section of the workpiece 39 within the die aperture. A pair of rounded, laterally outermost, compression surfaces 36 border the die aperture while extending across the plane of the centerlines of the individual, generally circular apertures 32. The compression surfaces 36 extend somewhat transversely to the longitudinal direction through the die 28, converging continuously toward one another from the entrance end 29 to the exit end 31. Due to such convergence of the compression surfaces 36, the tape 17, upon being displaced through the second deformation zone of the die aperture, will be subjected to substantially lateral compressive forces along its outermost lateral edges 24. Such forces will deform the workpiece into a laterally more compact structure, while transforming the junction regions 21 of the tape 17 into substantially circular, arcuate cross-sectional shape. The configuration of the individual, generally circular apertures 32 preferably varies continuously from the entrance end 29 (FIG. 6) to the exit end 31 (FIG. 8) of the die 28 in such manner as to accommodate the rounding out of the elongated elements 18 into substantially fully circular cross-sectional shape. In particular, the rounded central portions 33 of the generally circular apertures 32 acquires an increasingly greater depth and are arrayed closer to one another laterally, as they approach the exit end 31 of the die 28, such that substantial portions of the workpiece 39 may remain clear of the periphery of the die aperture as the workpiece 39 is deformed by the application of substantially lateral compressive forces along the compression surfaces 36 of the die 38.

In connection with the operation of the apparatus and the performance of the methods of the invention, reference will now also be made to FIG. 9 of the drawing. FIG. 9 illustrates pertinent portions of an apparatus which may utilize an appropriate die, such as the die 28, in order to form the tape 13. This apparatus is more fully described in my copending application, Ser. No. 612,875, filed Sept. 12, 1975 and entitled, "Continuous Wire Extrusion." The apparatus includes a number of gripping element sectors 37 which are advanced from left to right as illustrated in FIG. 9. As the sectors 37 advance toward the right, they are subjected to a continuously increasing compressive pressure, as indicated by arrows 38 which increase in size from left to right.

A workpiece 39, for example, a copper or aluminum rod of indefinite length, has its outer periphery coated with a fluent material 41. Shear stresses transmitted through the material 41, which may be beeswax or polyethylene wax, serve to advance the workpiece 39 from left to right in FIG. 9, with the advancing sectors 37. At the same time, compressive stresses of continually increasing magnitude are also imposed on the advancing workpiece, thereby rendering the workpiece considerably more ductile and more suited to extrusion. The material 41, in addition to its ability to act as a shear transmitting medium, has lubricative properties, and serves to lubricate the die aperture of a die, e.g., the die 28 of die assembly 23, through which the workpiece 39 is extruded, thereby reducing the axial forces required for extrusion. Such extrusion takes place, with the workpiece rendered suitably ductile by the compressive pressures exerted upon it, as the workpiece is forced against the die 28 and through its aperture, by shear force in the material 41. The die assembly 23 may be carried on a suitable die stem 42.

As each successive portion of the workpiece 39 is displaced longitudinally through the aperture of the die 28, it is subjected to the two stages in the formation of the tape 13, as discussed previously. Such two stages take place one immediately after the other in the two longitudinally aligned, effective deformation zones of the die aperture. In the first stage of deformation, performed at the entrance end 29 of the die, the workpiece portion acquires the intermediate configuration of the tape 17 of FIG. 4. In the second stage, which continues with displacement of the workpiece portion through the body of the die 28 up to its passage through the exit end 31, the intermediate structure of FIG. 4 is transformed onto the desired tape structure of FIG. 3, due to the application of substantially lateral compressive forces by the converging compression surfaces 36 of the die 28 to the outermost lateral edges 24 of the tape 17.

It is to be understood that the described methods and apparatus are simply illustrative of a preferred embodiment of the invention. It should be clear that the specified two stages of formation of the desired tape 13 need not take place in immediate succession, but may instead be performed at different times, for example, using different dies. Moreover, various alternative angles and/or non-flat shapes may replace the flat, ninety degree surfaces 34 of the die. Indeed, the die might be so configured that the shape of the intermediate structure, produced by the first stage of deformation, corresponds to that of the tape 11 of FIG. 1, with compressive forces transversely applied to the tape 11 in the second stage of deformation serving to round out the adjacent corners of the individual wires 12. Many other modifications might also be made within the scope of the invention.

What is claimed is:

1. A method of hydrostatic extrusion for deforming an elongated workpiece so as to form an integral article, which article comprises a plurality of elongated members, each of substantially circular cross-section, extending longitudinally in parallel while arrayed in a substantially laterally extending line, and joined together in edge-to-edge contact substantially along parallel, longitudinally extending lines of tangency between adjacent elongated members, the method comprising the steps of:

a. applying hydrostatic forces to the elongated workpiece in such direction as to extrude the elongated workpiece through first die aperture wall means, having a fixed configuration and shaped to deform the elongated workpiece into an intermediate structure, which intermediate structure comprises a plurality of elongated elements extending in a longitudinal direction, in parallel, while arrayed in a substantially laterally extending line, and joined together along adjacent lateral edges of adjacent elements, each of said elements having a cross-section which includes a substantially circular, arcuate portion between said adjacent lateral edges of adjacent elements and a non-circular, junction region generally converging toward each of said adjacent lateral edges of adjacent elements; and thereafter b. further extruding said intermediate structure, by means of said hydrostatic forces, through second die aperture wall means, having a fixed configuration and shaped to compress said intermediate structure substantially laterally, along the substantially laterally extending line in which the plurality of elongated elements are arrayed in said intermediate structure, to round out said non-circular, junction regions in such manner as to form an integral article comprising a plurality of elongated members, equal in number to the number of elongated elements in said plurality of elongated elements, with the elongated members each having a substantially circular cross-sectional shape, and being joined together along adjacent lateral edges of adjacent elongated members.

2. A method as set forth in claim 1, wherein step (a) comprises:

c. forming said intermediate structure with the cross-section of each of said elongated elements having a pair of diametrically opposed, substantially circular, arcuate portions between adjacent lateral edges of adjacent elements.

3. A method as set forth in claim 1, wherein step (a) comprises:

c. forming said intermediate structure with adjacent, non-circular, junction regions which converge along substantially flat surfaces, said surfaces meeting one another at substantially 90° angles.

4. A method as set forth in claim 1, wherein step (a) comprises:

c. displacing the workpiece longitudinally through first die aperture wall means which define a plurality of generally circular apertures arrayed in a substantially laterally extending line and interconnected by non-circular, junction areas which converge along substantially flat surfaces, said surfaces meeting one another at substantially ninety degree angles.

5. A method as set forth in claim 1, wherein:

c. the performance of step (b) follows immediately the performance of step (d).

6. Apparatus for deforming an elongated workpiece by hydrostatic extrusion so as to form an integral article, which article comprises a plurality of elongated members, each of substantially circular cross-section, extending longitudinally in parallel while arrayed in a substantially laterally extending line, and joined together in edge-to-edge contact substantially along parallel, longitudinally extending lines of tangency between adjacent elongated member, the apparatus comprising:

first die aperture wall means, having a fixed configuration and effective upon passage of the elongated workpiece therethrough, for deforming the elongated workpiece into an intermediate structure, which intermediate structure comprises a plurality of elongated elements extending in a longitudinal direction, in parallel, while arrayed in a substantially laterally extending line, and joined together along adjacent lateral edges of adjacent elements, each of said elements having a cross-section which includes a substantially circular, arcuate portion between said adjacent lateral edges of adjacent elements and a non-circular, junction region substantially converging toward each of said adjacent lateral edges of adjacent elements;

second die aperture wall means, having a fixed configuration and effective upon passage of said intermediate structure therethrough, for compressing said intermediate structure substantially laterally, along the substantially laterally extending line in which the plurality of elongated elements are arrayed in said intermediate structure, to round out said non-circular, junction regions in such manner as to form an integral article comprisng a plurality of elongated members, equal in number to the number of elongated elements in said plurality of elongated elements, with the elongated members each having a substantially circular cross-sectional shape, and being joined together along adjacent lateral edges of adjacent elongated members;

the lateral distance across said second die aperture wall means being smaller than the lateral distance across said first die aperture wall means;

each said die aperture wall means having a plurality of interconnected apertues; and means for applying hydrostatic forces to the elongated workpiece in such direction as to extrude the elongated workpiece, first through said first die aperture wall means and thereafter, as said intermediate structure, through said second die aperture wall means.

7. Apparatus as set forth in claim 6, wherein:

said first die aperture wall means comprise means for forming said intermediate structure with the cross-section of each of said elongated elements having a pair of diametrically opposed, substantially circular arcuate portions between adjacent lateral edges of adjacent elements.

8. Apparatus as set forth in claim 6, wherein said first die aperture wall means define a plurality of generally circular apertures arrayed in a substantially laterally extending line and interconnected by non-circular, junction areas which converge along substantially flat surfaces, said surfaces meeting one another at substantially 90° angles.

9. Apparatus as set forth in claim 6, the apparatus further comprising:

means, aligning said first die aperture wall means and said second die aperture wall means longitudinally, for uniting said first and second die aperture wall means in a single, integral structure, such that deformation of the elongated workpiece into the intermediate structure will be followed immediately by further deformation of the intermediate structure into the desired integral article, as the elongated workpiece is extruded longitudinally, successively through said first and second die wall means.

10. Apparatus for deforming an elongated workpiece by hydrostatic extrusion so as to form an integral article, which article comprises a plurality of elongated members, each of substantially circular cross-section, extending in parallel while arrayed in a laterally extending line, and joined together in edge-to-edge contact substantially along parallel, longitudinally extending lines of tangency between adjacent elongated members, the apparatus comprising:

first die aperture wall means, having a fixed configuration which defines a plurality of generally circular apertures arrayed in a substantially laterally extending line and interconnected by non-circular, junction areas which converge along substantially flat surfaces, said surfaces meeting one another at substantially ninety degree angles, such that an elongated workpiece, upon being displaced longitudinally through said first die aperture wall means, will be deformed into an intermediate structure comprising a plurality of substantially circular elongated products extending longitudinally in parallel while arrayed in a laterally extending line, and joined together along non-circular, junction regions at adjacent lateral edges of adjacent elements;

second die aperture wall means, having a fixed configuration which is so configured as to apply substantially lateral compressive forces to said intermediate structure upon the displacement of said intermediate structure longitudinally through said second die aperture wall means;

the lateral distance across said second die aperture wall means being smaller than the lateral distance across said first die aperture wall means;

each said die aperture wall means having a plurality of interconnected apertures; and means for applying hydrostatic forces to the elongated workpiece in such direction as to extrude the elongated workpiece longitudinally, first through said first die aperture wall means and then, as said intermediate structure, through said second die aperture wall means.

11. Apparatus as set forth in claim 10, the apparatus further comprising:

means, aligning said first die aperture wall means and said second die aperture wall means longitudinally, for uniting said first and second die aperture wall means in a single, integral structure, such that deformation of the elongated workpiece into the intermediate structure will be followed immediately by further deformation of the intermediate structure into the desired integral article.

* * * * *

UNITED STATES PATENT OFFICE

CERTIFICATE OF CORRECTION

Patent No. 4,068,517 Dated January 17, 1978

Inventor(s) F. J. Fuchs, Jr.

It is certified that error appears in the above-identified patent and that said Letters Patent are hereby corrected as shown below:

In the specification, Column 1, line 59, "pressure" should read --pressures--. Column 4, line 23, "exit 31" should read --exit end 31--; line 26, "tape 13" should read --tapes 13--; line 39, "tape 3" should read --tape 13--. Column 5, line 13, "acquires" should read --acquire--; line 20, "die 38" should read --die 28--; line 54, "force" should read --forces--.

In the claims, Column 7, line 55, "comprisng" should read --comprising--; line 66, "apertues" should read --apertures--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*